United States Patent [19]

Chubb

[11] 4,349,975

[45] Sep. 21, 1982

[54] KEY ATTACHMENT

[76] Inventor: Wayne L. Chubb, P.O. Box 531, Beverly Shores, Ind. 46301

[21] Appl. No.: 240,845

[22] Filed: Mar. 5, 1981

[51] Int. Cl.[3] ..... G09F 3/00; A44C 3/00; G09F 3/18

[52] U.S. Cl. ..... 40/330; 40/2 A; 40/10 D; 40/600; 40/574

[58] Field of Search ..... 40/330, 2 A, 10 R, 10 D, 40/1.5-1.6, 21 C, 574, 600, 160, 315, 331; D3/61-65; 362/116; 70/456 R, 457, 459, 460; 150/40

[56] References Cited

U.S. PATENT DOCUMENTS

| | | | |
|---|---|---|---|
| 2,759,279 | 8/1956 | Schlage | 40/330 |
| 2,759,280 | 8/1956 | Schlage | 40/330 |
| 2,781,594 | 2/1957 | Stupell | 40/330 |
| 2,932,107 | 4/1960 | Manzardo | 40/330 |
| 2,982,041 | 5/1961 | Kent | 40/330 |
| 3,123,926 | 3/1961 | Jacobson | 40/330 |
| 3,209,479 | 10/1965 | Manzardo | 40/330 |
| 3,236,204 | 2/1966 | Joseph | 40/622 |
| 3,648,394 | 3/1972 | Hepner | 40/331 |
| 4,236,331 | 12/1980 | Mattson | 40/1.5 |
| 4,291,475 | 9/1981 | Schoemer | 40/10 D |

*Primary Examiner*—Paul J. Hirsch
*Assistant Examiner*—Michael J. Foycik, Jr.
*Attorney, Agent, or Firm*—Marmaduke A. Hobbs

[57] ABSTRACT

A key attachment for affixing identifying information to a key in which a handle has a recess therein and the head of the key is retained in the recess, with the shank of the key projecting outwardly from the handle. A sheet with the identifying information is disposed on the top of the key in the handle, and a clear cover is disposed on top of the sheet and is locked to the handle. The means for retaining the key head in the handle may be a filler piece in the recess having a cutout conforming to the shape of the head of the key, a post or rivet interconnecting the key and the bottom of the recess, a layer of malleable material in the recess in which the head of the key is embedded, or a layer of material in the recess having a high coefficient of friction against which the head of the key is held under pressure.

11 Claims, 16 Drawing Figures

KEY ATTACHMENT

BACKGROUND OF THE INVENTION

This invention relates to an identification attachment for keys, which makes a key easily distinguishable from other similar keys, and which assists in segregating keys of various types, or to various locks.

Keys for similar types of locks generally have quite similar appearances. While it is normally not difficult to distinguish a car key from a house door key, for example, because of differences in the general shapes of the heads of the keys, the locks produced by any one manufacturer for a particular use will normally be operable by keys with the same shape of head, and the only difference between the keys for different locks from the same manufacturer is in the pattern cut in the shank of the key which operates the tumblers in the lock. For most people the pattern cut in the key shank is not sufficiently distinctive to assist in readily ascertaining which key is for which lock. For example, without identifying indicia on the key it is difficult to determine which of several automobile keys is for a particular automobile, or which of several keys for a given brand of door lock is for a particular door. Even when the keys have different shaped heads it may be difficult to distinguish the keys merely by touch in dark or poorly lighted areas.

The problem of key identification is particularly significant for maintenance and security personnel, or the like, who may have several hundreds of similar keys for operating locks to various rooms in a large complex. Master keys which open all locks in a particular series of locks can be used; however, in some cases a person may need access to many but fewer than all of the doors in the series. For security purposes it is undesirable to give everyone unlimited access by providing master keys; therefore, individual keys are provided for each door to which the person is entitled to have access. Various means of identification have been used for keys, each having some significant disadvantages. Tags with identifying information have been used, either attached by string, wire or the like to the key, or attached directly on the head of the key by adhesive. Tags attached by string or the like make the keys disorderly, particularly when a plurality of keys with dangling tags are kept together on a key ring or in a key cabinet. Either type of tag, those attached by string or those attached by adhesive, can become dislodged from the keys when a plurality of keys are carried together. Permanent key identification can be etched in the head of the key with an engraver; however, the engraving is often difficult to read, particularly in poorly lighted areas, and the identification information is not easily changed. It is a security policy in some buildings, such as dormitories, to periodically exchange the locking mechanisms of the various doors so that if a key has been stolen, or if a previous tenant has retained a key, the key will not open the door to the room it did originally. If the keys are identified by room numbers or location, the identification information must be changed on all remaining keys when the locks are changed.

Various other types of add-on identifying devices have been used; however, most are either not of a sufficiently permanent nature to be entirely satisfactory or require special tools for the attachment thereof, so that the devices are impractical for an individual to use when only a few keys are to be identified.

SUMMARY OF THE INVENTION

It is therefore one of the principal objects of the present invention to provide a key attachment which can be attached securely to the head of a key and contains identifying information for the key to indicate which lock the key will operate, and which standardizes the shapes of a plurality of keys to make storage of the keys and carrying of the keys on key rings or the like more orderly.

Another object of the present invention is to provide an identifying key attachment which can be attached to a key without the use of special tools, for permanent identification of the key, and which can be changed if the identification information on the key is to be changed.

Yet another object of the present invention is to provide an identifying key attachment which makes reading of the identifying information on the attachment easier in dark or poorly lighted areas, and which will make it easier for persons who have difficulties in holding onto keys to turn the key in a lock.

A further object of the present invention is to provide a key attachment for identifying keys which can be used on keys of all sizes and shapes, and which can be used to color code the keys for quick differentiation of keys to various types or classes of locks.

These and other objects are achieved in the present invention by providing a handle to fit over the head of a key, with means in the handle for holding the head of the key to prevent movement of the key relative to the handle. A sheet containing the identifying information is placed on top of the head of the key in the handle, and a clear plastic cover snaps into retaining fixtures in the handle, hence holding the key in the handle and the identifying sheet in place on top of the key. The enlarged handle makes manipulation of the key in the lock easier, particularly for people afflicted with physical infirmities which lessen their grip, and the standardized handle shape makes key storage more orderly.

The means for retaining the head of the key in the handle, to prevent the movement of the key relative to the handle, in the preferred embodiment is a filler piece having a cutout therein corresponding to the shape of the head of a key. The filler is closely fitted in a recess of the handle and is held therein by the clear plastic cover. When the attachments are to be used for several different types of keys, fillers are provided having cutouts to conform to the shapes of the heads of each type of key on which the attachment will be used. As an alternative to the filler piece having a cutout corresponding to the shape of the head of the key, a layer of sponge material having a high coefficient of friction may be used in the recess of the handle, so that when the cover is placed on the handle, over the head of the key, the key is held under pressure against the sponge material, and is prevented from movement relative to the handle. As yet another alternative, a layer of material which is malleable may be disposed in the handle so that, as the cover is pressed over the key, the head of the key is impressed into the layer of material, which then hardens, holding the key in place. Further alternatives for holding the head of the key relative to the handle include the use of rivets and other attaching devices in the key, all of which are held in place by the snap-on type locking cover. Thus, the present identifying attachment can be used on all types of keys without the need for special tools to attach the device to the key. The handle and cover can be of different colors for segregating keys, and fluorescent material can be used to assist in identifying the keys in dark or poorly lighted areas.

Further objects and advantages of the present invention will become apparent from the following detailed description and the accompanying drawings.

DETAILED DESCRIPTION OF THE PREFERRED EMBODIMENT

Figure 1:
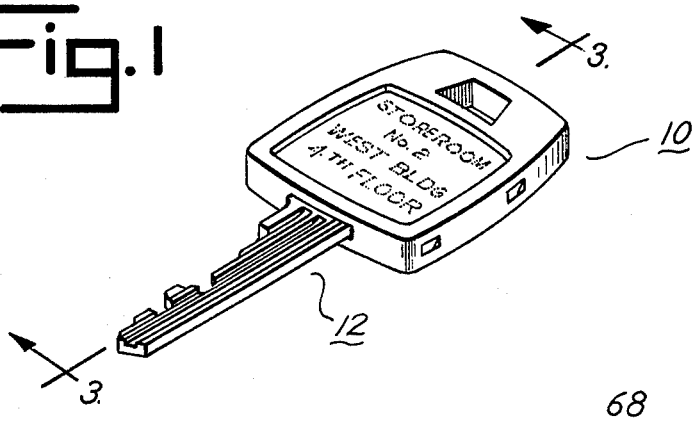
FIG. 1 is a perspective view of an identifying key attachment embodying the present invention attached to a key.
Figure 2:
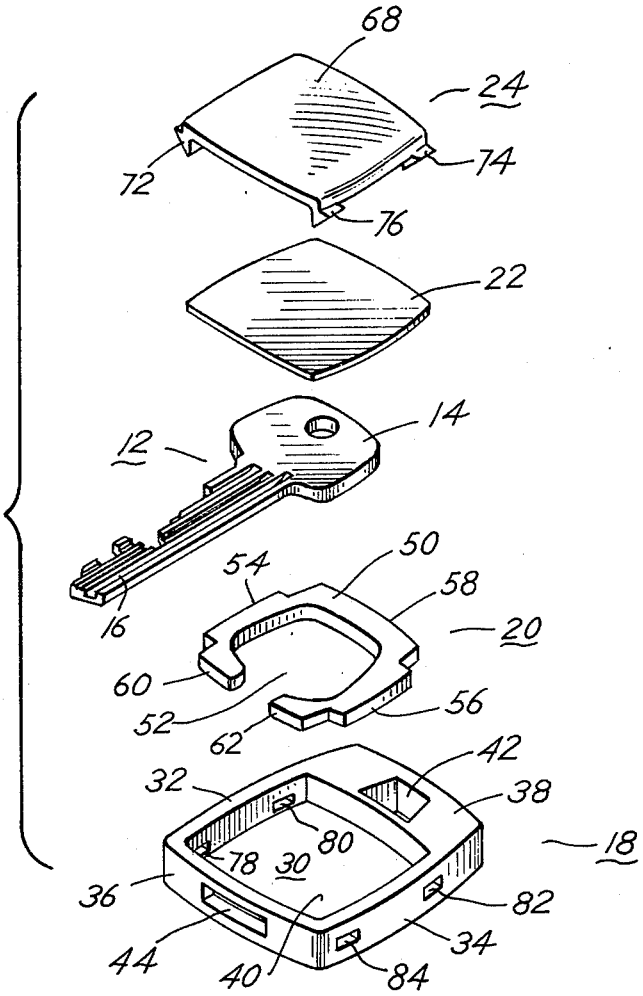
FIG. 2 is an exploded view of the key attachment and key shown in FIG. 1.
Figure 3:
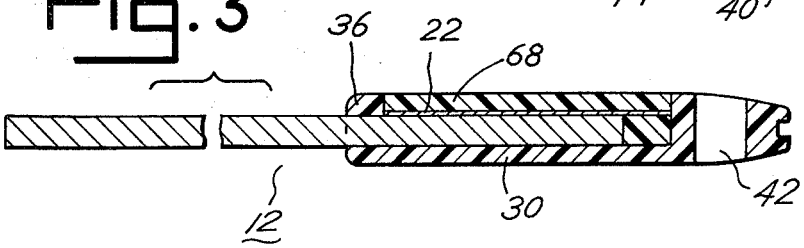
FIG. 3 is a longitudinal cross sectional view of the key and key attachment shown in FIG. 1, taken on line 3—3 of the latter figure.
Figure 4:
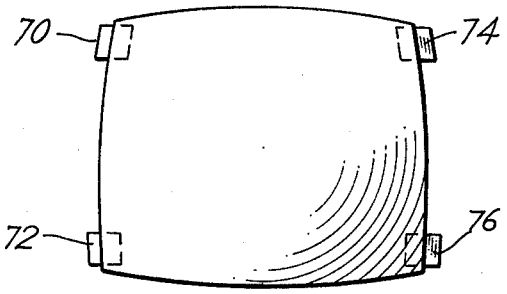
FIG. 4 is a plan view of the cover of the present key attachment.
Figure 6:
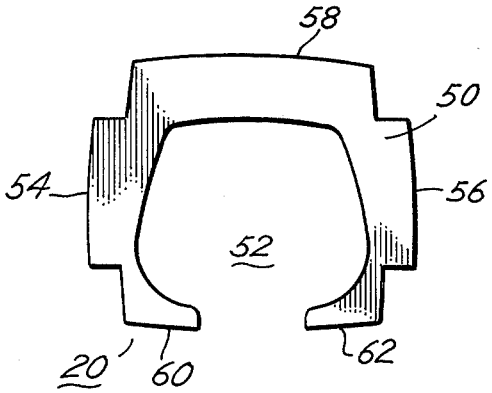
FIG. 6 is a plan view of the key head retaining filler piece used in the present key attachment.
Figure 5:
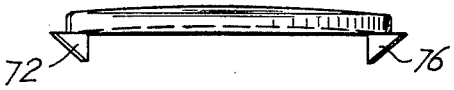
FIG. 5 is an end view of the cover shown in FIG. 4.
Figure 7:
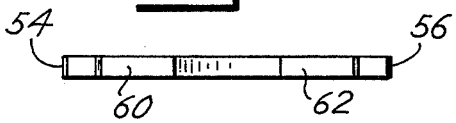
FIG. 7 is an end elevational view of the head retaining filler piece shown in FIG. 6.
Figure 9:
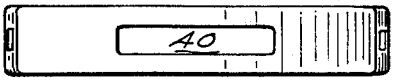
FIG. 9 is an elevational view of the end of the handle from which the key shank protrudes.
Figure 8:
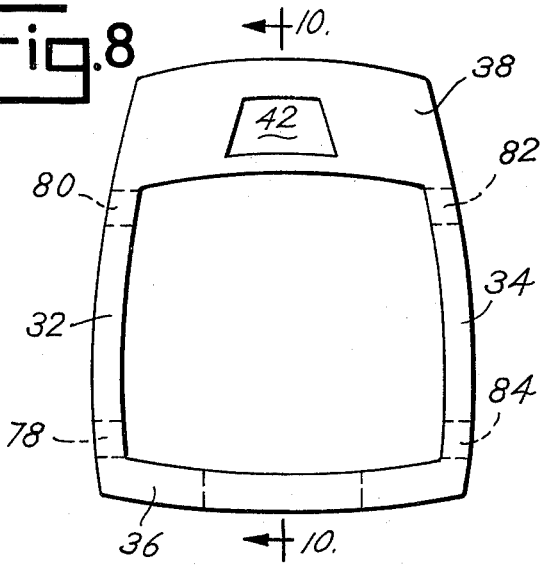
FIG. 8 is a plan view of the key handle of the present key attachment.
Figure 10:
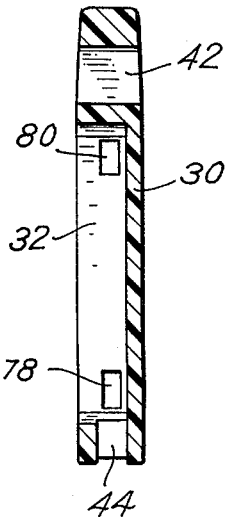
FIG. 10 is a cross sectional view of the handle shown in FIG. 8, taken on line 10—10 of the latter figure.
Figure 11:
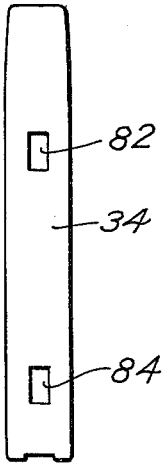
FIG. 11 is an elevation view of the side of the key handle.

Referring now more specifically to the drawings, and to FIG. 1 in particular, numeral 10 designates a key attachment embodying the present invention, which is shown affixed to a key 12 which has a head 14 and a shank 16. The present key attachment may be used on most types and shapes of keys, and the attachment itself may be virtually any desirable size or shape. For example, the overall configuration of the key attachment can be round, basically rectangular as shown or the like. The attachment can be just slightly larger than the head of the key, or it can be considerably larger than the head of the key, hence making the attachment particularly advantageous for use on small keys, or when a large grasping area is desirable for the key, such as when the key is for a lock which is difficult to operate.

Key attachment 10 includes a handle 18 in which head 14 of the key is secured and from which shank 16 of the key protrudes. A filler piece 20 fits into handle 18 and has a cutout therein conforming to the shape of head 14 of key 12. A paper or other sheet material 22 on which the identifying information can be printed, inscribed or otherwise affixed, fits on top of the key head in handle 18, and a cover 24 is disposed over paper 22 and is secured to handle 18 in the fully assembled key attachment for protecting the paper and for holding the assembly together.

Handle 18 will normally be of plastic, and is essentially a housing for holding the head of the key in filler piece 20, with paper 22 and cover 24 on top thereof. Hence, handle 18 includes a bottom 30, sides 32 and 34, a bottom end 36 and a top end 38 defining an inner area or recess 40 which is of sufficient size for holding filler piece 20, key head 14 and paper 22. When cover 24 is attached to the handle, the key head and filler piece should be held snugly against bottom 30. Top end 38 of handle 18 includes a hole 42 so that the attachment with key therein may be placed on hooks, pegs, or the like, or for affixing the key and attachment to a key chain or ring. Bottom end 36 of handle 18 includes an elongated opening 44 extending into recess 40, through which key shank 16 protrudes from the handle. Hence, in placing the key in handle 18, shank 16 is inserted into opening 44 from the inside of bottom end 36, and the shank is slid therethrough until head 14 can be positioned in recess 40. Normally, when a key is inserted through opening 44, filler piece 20 will be in place in recess 40 to receive the head.

Filler piece 20 is essentially a plastic body 50 with a cutout 52 for receiving head 14 and a portion of shank 16 adjacent head 14. Cutout 52 can be made to correspond to the shape of virtually any key head, and therefore a variety of filler pieces for various types of keys can be used in the same handle 18. The external dimensions of body 50 are only slightly smaller than the dimensions of recess 40, so that the body will fit in the recess but will not move for any substantial distance when the cover is in place on handle 18. Hence, preferably side edges 54 and 56 of body 50 are in contact with the inner surfaces of sides 32 and 34, respectively, when the body is in recess 40, and top edge 58 of the body is in contact with the inner surface of top end 38. Cutout 52 divides the bottom edge into segments 60 and 62 which, preferably, are in contact with the inner surface of bottom end 36 on either side of opening 44. Thus, filler piece 20 is held from movement in all directions when cover 24 holds the filler piece against bottom 30. The corners of the filler piece are notched, as shown in the drawings, to accommodate the attachment of cover 24 to handle 18 in a manner which will be described more fully hereinafter.

Sheet 22 will normally be paper, lightweight cardboard or other material on which the desired identifying information can be written. The sheet should be of a quality to resist yellowing or other discoloration or deterioration from age. The outer dimensions of sheet 22 are only slightly smaller than the dimensions of recess 40, so that the sheet will fit in the recess on top of head 14 and filler piece 20, but will not move substantially therein.

Cover 24 will normally be of clear plastic so that writing, printing or other information contained on sheet 22 is visible through the cover. The cover includes a clear top panel or lens 68 with downwardly and outwardly extending lugs 70, 72, 74 and 76 disposed one at each corner of the lens. Sides 32 and 34 of body 18 contain holes 78, 80, 82 and 84 for receiving the lugs from lens 68. The corners of filler piece 20 are notched so that holes 78, 80, 82 and 84 in sides 32 and 34 may be positioned at the lower portion of the sides, and the downwardly and outwardly extending lugs of the cover extend downwardly along the sides of filler piece 20, and into the receiving holes of the handle. In this manner the various components, including handle 18, filler piece 20, key 12, sheet 22 and cover 24, are held securely together when the lugs of the cover are snapped into the holes of the handle.

In the use and operation of a key attachment embodying the present invention, the appropriate size, shape and color handle is selected for the key being identified, and the identifying information is printed, typed or otherwise placed on sheet 22. A filler piece 20 having a cutout 52 corresponding to the head of the key being identified is selected and is placed in recess 40 of handle 18. The extreme outer edges of the filler piece will be in contact with the inner surfaces of the walls defining the recess in the handle so that the filler piece cannot move noticeably in the handle. Shank 16 of key 12 is inserted into opening 44 from the inner side of bottom end 36, and the shank is slid therethrough until head 14 is in the proper position to slide into cutout 52 of filler piece 20. Sheet 22 containing the identifying information is placed on top of head 14 and filler piece 20 and will normally be of the same shape and size as recess 40. Cover 24 is placed on top of sheet 22 and is pushed downwardly until lugs 70, 72, 74 and 76 become lodged in holes 78, 80, 82 and 84. Normally lens 68 will be disposed in recess 40 when the lugs are disposed in holes 78, 80, 82 and 84, so that the upper surface of lens 68 is flush with the upper surfaces of handle 18. The lugs extend downwardly along the sides of filler piece 20, and when the lugs are snapped into the holes in handle 18, the key, filler piece and sheet 22 are held together under a slight pressure between lens 68 and bottom 30 of the handle. Once the lugs are lodged in the holes, the lugs cannot be dislodged therefrom easily, and therefore provide a permanent fixation of the key attachment to the key. If desired, a solvent can be used to cause the lens, and particularly the lugs thereof, to fuse with the portions of body 18 with which they are in contact, thereby making removal of the attachment with the identifying information not possible without destroying the key attachment and handle.

Figure 12:
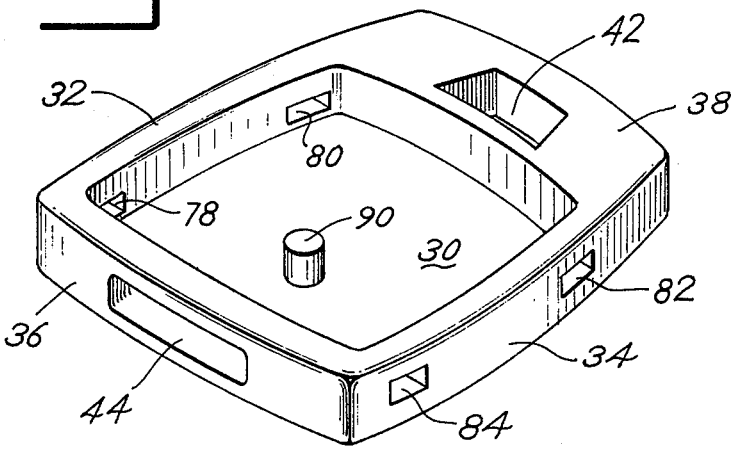
FIG. 12 is a perspective view of a modified form of key handle which may be used without the head retaining filler piece.
Figure 13:
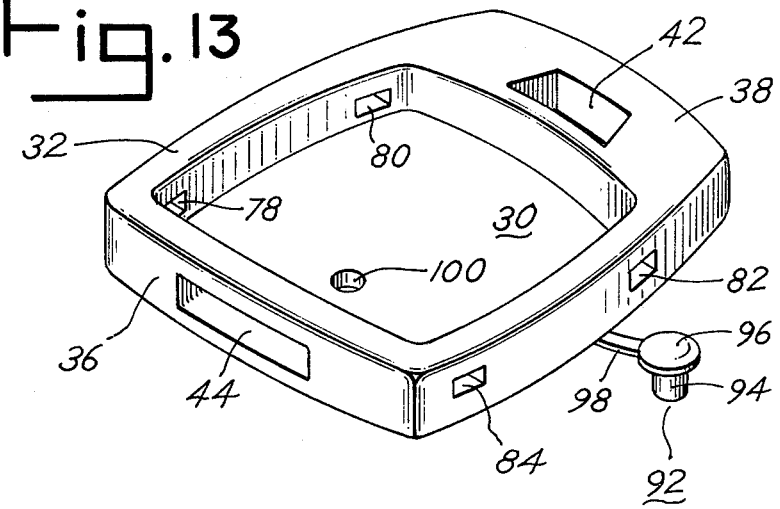
FIG. 13 is a perspective view of another modified form of the key handle.
Figure 14:
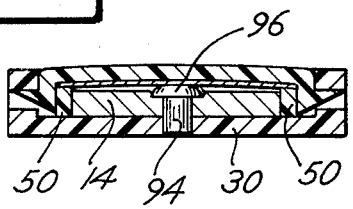
FIG. 14 is a cross sectional view of the handle shown in FIG. 13 having a key head retained therein.

In the embodiment of handle 18 shown in FIG. 12, a post 90 is disposed in recess 40 and extends upwardly from bottom 30 thereof. When this modified form is used, a hole is punched in the key for receiving post 90, and a filler piece 20 may or may not be used as desired. Opening 44 minimizes the lateral movement of shank 16 relative to handle 18, and post 90 minimizes the longitudinal movement of the shank relative to the handle. In a slight variation of the above embodiment, which is shown in FIG. 13, when handle 18 is produced, a rivet 92 having a stem 94 and head 96 can be joined to handle 18 by breakable connector piece 98. A hole 100 is disposed in bottom 30 of the handle, and a hole is formed in the key prior to insertion of the key in the handle. When the key is placed in the handle so that the hole in the key aligns with the hole in the handle, rivet 92 is placed with head 96 on top of the key, and stem 94 extending through the hole in the key and hole 100 in handle 18. The paper sheet with identifying information is placed on top of the key and head 96 of rivet 92, and, as shown in FIG. 14, when cover 24 is snapped into place on handle 18, the rivet cannot be removed from the key and handle, and holds the key in position in the handle in much the same manner as post 90 holds the key in the previous embodiment. When this modified form is used, the use of a filler piece is optional.

Figure 15:
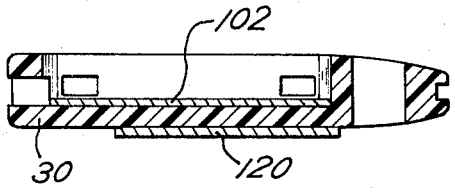
FIG. 15 is a cross sectional view of yet another modified form of key handle used in the present key attachment.

In yet another modified form of the invention shown in FIG. 15, a layer of material 102 is disposed on bottom 30 in recess 40. In one variation of this embodiment, layer 102 is a sponge-like material with a surface having a high coefficient of friction. When cover 24 is snapped in place on handle 18, the lens holds the key under pressure against layer 102, and the key is therefore restricted in movement relative to handle 18. In another variation of this embodiment, layer 102 comprises a material which is malleable, and when cover 24 is snapped in place, head 14 of key 12 becomes embedded in layer 102. It is preferred that layer 102 then harden around the key to hold the key in place relative to handle 18. The hardening may be a result of time or a result of a reaction of the layer to a solution in which the key and attachment are immersed. The use in recess 40 of a layer 102 consisting of either sponge material with a high coefficient of friction or of malleable material as just described, is particularly advantageous in that no modification of the key head is required, and the same type of handle can be used for many different shapes of keys. A filler piece is not required; hence, the person using the key attachments need not have a variety of the filler pieces on hand for the various types of keys on which the attachments will be used.

Figure 16:
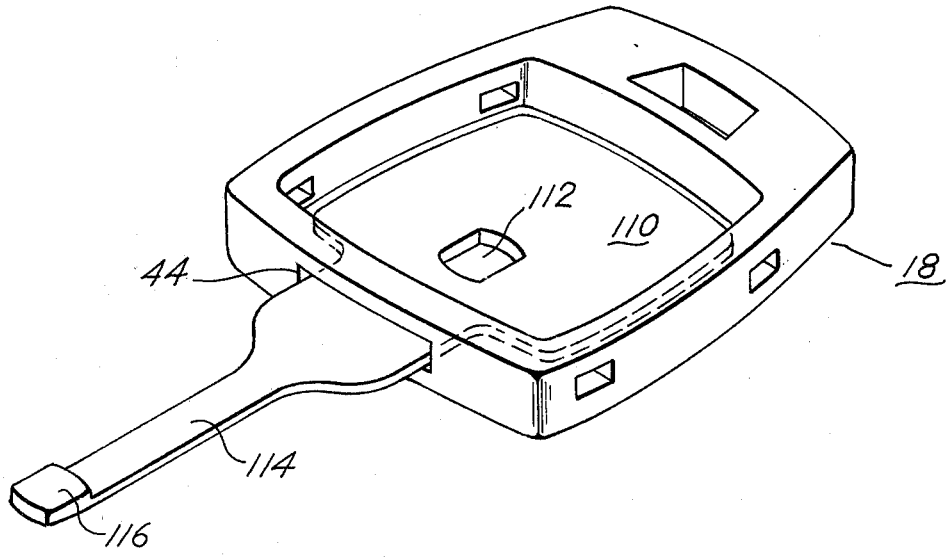
FIG. 16 is a perspective view of still another modified form of key handle for the present invention.

The basic concept and structure of the present key attachment can also be used when a dangling type of tag is desired for the key. A suitable embodiment for such a tag is shown in FIG. 16. A filler piece 110 is disposed in the bottom of recess 40 and includes a hole 112 therethrough. A flexible strap 114 extends outwardly from filler piece 110, through opening 44, and has a knob 116 at the end thereof. Knob 116 is only slightly smaller than hole 112 and will slide into hole 112 if flexible strap 114 is doubled back through opening 44 to align the knob and hole 112. Flexible strap 114 is inserted through the hole at the top of a key and is doubled back through opening 44 so that knob 116 may be placed in hole 112. A sheet 22 having the identifying information is placed on top of filler piece 110, and cover 24 is snapped in place in recess 40. Knob 116 is held in hole 112 between lens 68 and bottom 30 and cannot be dislodged therefrom. Thus, the key is permanently attached to the identifying tag.

Any of the key attachments of the present invention may have a magnet 120 disposed on the back of bottom 30 so that the key and key attachment can be placed on a piece of metal such as in a key cabinet or metal key rack. The key and attachment with the magnet thereon also can be used as a hidden spare key for various locks. For example, many car owners conceal a set of car keys at some hidden, but accessible location on the outside of the car, so that if they lose their keys and the car door is locked the spare set of keys can be used to enter and drive the car. With a magnet on the back of the key attachment, the key and attachment can be used and are more easily concealed than a large box with magnet holding the key, or other presently used concealed key holders.

The present key attachments permit convenient sorting of keys. For example, key attachments of different colors can be used for various types of locks. Thus, all car keys could be of one color, all house or door keys of another color, and the like. Although the key attachments are of a permanent nature, particularly when a solvent is used for fusing the cover to the handle, the key or head of the key is not damaged or marked when the key attachment is used. Thus, if locks are changed so that the identifying information in the key attachment is no longer correct, the key attachment can be removed, though it may be destroyed, and a new attachment with the correct information can be placed on the key. The locking cover will securely hold the key attachment together even if a solvent is not used for fusing the cover to the handle. When it is known that the identifying information will be changed at some future date, the fusing step can be eliminated. The lugs can be forced from the holes in the handle so that a new sheet 22 with proper information thereon can be inserted in the handle.

The key attachment slightly enlarges the graspable portion of the key above shank 16. Thus, when the key is used for a lock which is difficult to operate, or when the standard key without attachment is small, the present key attachment can be particularly advantageous in making the operation of the key and lock easier. Key identification in dark or poorly lighted areas is made easier, first by the color coding which is possible with the present key attachment, and secondly the handles of the attachment can be made fluorescent. A fluorescent tint in the clear lens will illuminate the underlying identification information on sheet 22, which will be particularly distinctive if the handle is of a different fluorescent color. Further, lens 68 may have a curvature which magnifies the identification information which is visible therethrough on sheet 22, making the information more easily read. Storage of keys is easier when the present attachments are used, in that the attachments standardize the shapes of the keys so that the keys will fit together more easily and will present a more pleasant and orderly appearance.

Although an identifying attachment for keys and several modifications thereof have been shown and described in detail herein, additional changes may be made without departing from the scope of the present invention.

I claim:

1. A key attachment for affixing identifying information to a key, comprising a handle having a body with a bottom, and side, top and botton walls joined to said bottom and defining a recess in the handle for receiving the head of the key, means in said recess for holding the head of the key in a substantially fixed position relative to said handle, one of said walls of said handle having an opening through which the shank of the key extends, a sheet on which the identifying information is placed adapted to fit in said recess on top of the head of the key, a cover having a transparent portion through which the sheet with identifying information thereon is visible, cover securing means disposed on opposite sides of said cover, and recess means in the inner side of opposite walls for receiving said securing means for locking the cover onto said body.

2. A key attachment as defined in claim 1 in which a filler piece is disposed in said recess and has a cutout therein conforming to the shape of the head of the key.

3. A key attachment as defined in claim 2 in which said securing means include lugs extending outwardly from said cover, and said recess means are holes for receiving said lugs to hold said cover on said handle.

4. A key attachment as defined in claim 2 in which fluorescent material is disposed in said cover for illuminating the identifying information on said sheet.

5. A key attachment as defined in claim 1 in which a post extends upwardly from said bottom piece of said recess, and said post is disposed in a hole in the key when said attachment is on a key.

6. A key attachment as defined in claim 1 in which said means in said handle includes a rivet having a head and a shank extending from said head, a hole is disposed in said bottom of said recess, and said shank extends through a hole in the key and said hole in said bottom of said recess with said head of said rivet being disposed between the key and said cover when said attachment is disposed on a key.

7. A key attachment as defined in claim 1 in which a layer of malleable material is disposed in the bottom of said recess, and said cover holds the head of the key under pressure against said malleable material to impress the head of the key in said malleable material.

8. A key attachment as defined in claim 1 in which a layer of material is disposed in the bottom of said recess, said material has a high coefficient of friction, and said cover holds the head of the key under pressure against said layer of material when said attachment is disposed on a key.

9. A key attachment as defined in claim 1 in which a magnet is disposed on the back of said handle for attaching said handle to a metallic body.

10. A key attachment as defined in claim 1 in which said cover contains fluorescent material for illuminating the identifying information on said sheet.

11. A key attachment for affixing identifying information to a key comprising a body having a recess therein, means engageable with a portion of said key, a sheet on which the identification information is placed adapted to fit in said recess, a cover having a transparent portion through which said sheet with identifying information is visible, said sheet being disposed on top of said means when a key is affixed to said attachment, a second means for attaching said cover to said body, and a filler piece disposed in said recess, a flexible strap extending outwardly from said filler piece, an enlarged end disposed on said flexible strap, and a hole in said filler piece for receiving said enlarged end after said enlarged end and a portion of said flexible strap have been passed through a hole in the key, said enlarged end being held in said hole in said filler piece between the bottom of said recess and said cover.

* * * * *